US007352084B2

(12) United States Patent
Hall et al.

(10) Patent No.: US 7,352,084 B2
(45) **Date of Patent: *Apr. 1, 2008**

(54) DEACTIVATOR USING INDUCTIVE CHARGING

(75) Inventors: Stewart E. Hall, Wellington, FL (US); Steven V. Leone, Lake Worth, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 466 days.

This patent is subject to a terminal disclaimer.

(21) Appl. No.: 10/915,844

(22) Filed: Aug. 11, 2004

(65) Prior Publication Data

US 2006/0033621 A1 Feb. 16, 2006

(51) Int. Cl.
*H01F 27/42* (2006.01)

(52) U.S. Cl. ..... 307/104

(58) Field of Classification Search ..... 307/104; 340/572.3

See application file for complete search history.

(56) References Cited

U.S. PATENT DOCUMENTS 7,106,200 B2 * 9/2006 Hall et al. ..... 340/572.3

* cited by examiner

*Primary Examiner*—Robert L. DeBeradinis

(57) ABSTRACT

Method and apparatus for a deactivator using an inductive charging technique are described.

41 Claims, 14 Drawing Sheets

DEACTIVATOR USING INDUCTIVE CHARGING

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area.

When a customer presents an article for payment at a checkout counter, a checkout clerk either removes the security tag from the article, or deactivates the security tag using a deactivation device. In the latter case, improvements in the deactivation device may facilitate the deactivation operation, thereby increasing convenience to both the customer and clerk. Consequently, there may be need for improvements in deactivating techniques in an EAS system.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

Figure 1:
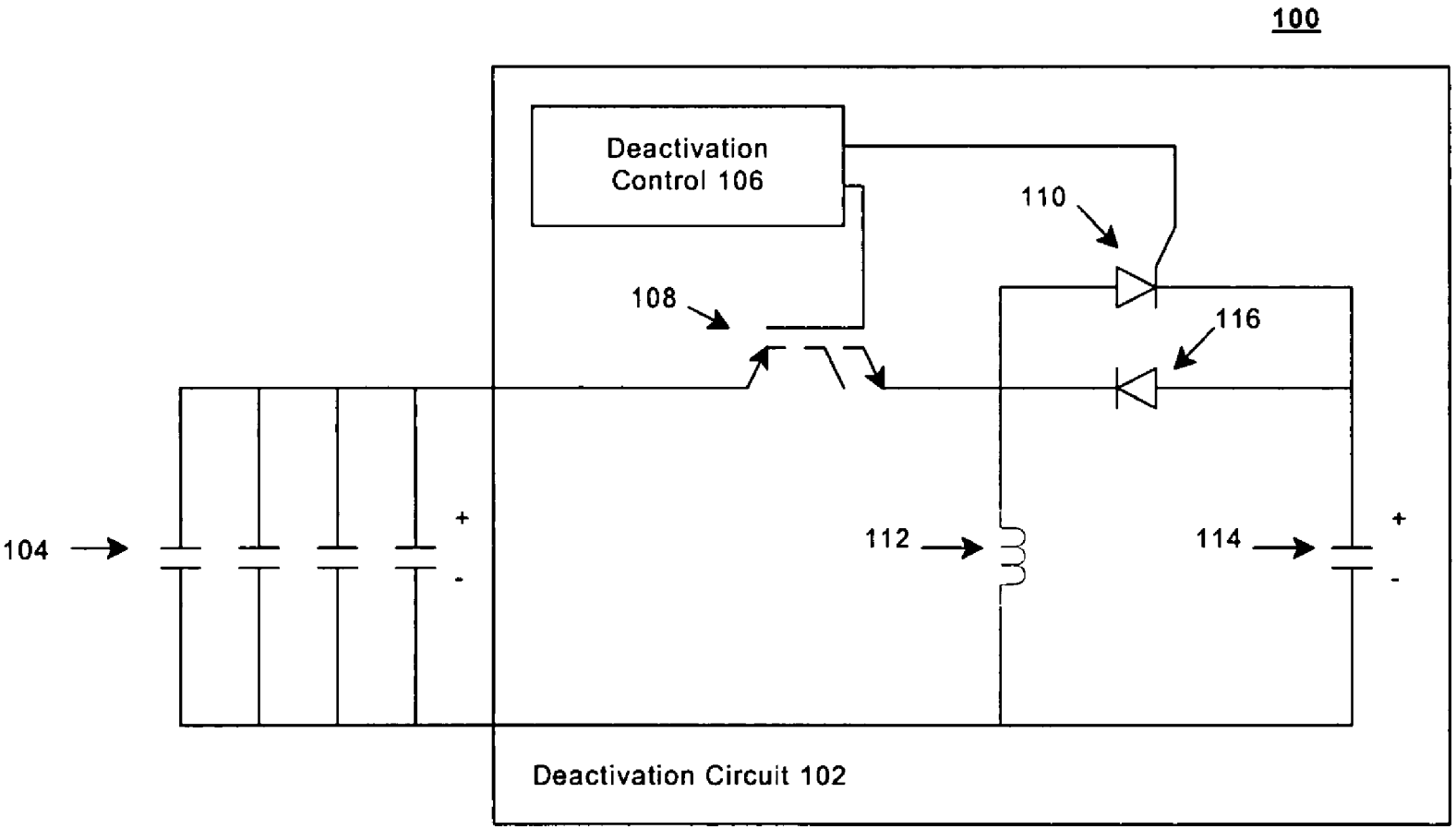
FIG. 1 illustrates a deactivator having a direct current (DC) power source in accordance with one embodiment.

Numerous specific details may be set forth herein to provide a thorough understanding of the embodiments. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

The embodiments may be directed to a deactivator for an EAS system. The deactivator may be used to deactivate an EAS security tag. The security tag may comprise, for example, an EAS marker encased within a hard or soft outer shell. The deactivator may create a deactivation field. The marker may be passed through the deactivation field to deactivate the marker. Once deactivated, the EAS security tag may pass through the interrogation zone without triggering an alarm.

An example of a marker for a security tag may be a magneto-mechanical marker. A magneto-mechanical marker may have two components. The first component may be a resonator made of one or more strips of a high permeability magnetic material that exhibits magneto-mechanical resonant phenomena. The second component may be a bias element made of one or more strips of a hard magnetic material. The state of the bias element sets the operating frequency of the marker. An active marker has its bias element magnetized setting its operating frequency within the range of EAS detection systems. Deactivation of the marker is accomplished by demagnetizing the bias element thereby shifting the operating frequency of the marker outside of the range of EAS detection systems. Techniques to demagnetize the bias element usually involve the application of an AC magnetic field that is gradually decreased in intensity to a point close to zero. To effectively demagnetize the bias element it may be necessary to apply a magnetic field strong enough to overcome the coercive force of the bias material prior to decreasing the intensity.

One technique to create this gradually decreasing AC magnetic field uses an inductor-capacitor (LC) resonant tank circuit. A deactivation capacitor may be charged prior to the beginning of the deactivation cycle. When the deactivation cycle begins, a switch connects the charged capacitor to a deactivation coil. Since this coil is inductive, it forms a resonant tank circuit with the charged deactivation capacitor. The resistances in the coil winding, the effective series resistance (ESR) of the switch and the deactivation capacitor, and the other losses in the circuit result in a resistive component in the LC resonant tank circuit. If the resistances in the tank circuit are low enough, the resulting LCR circuit will be under-damped and a gradually decreasing AC current will flow through the deactivator coil. This current flows through the winding of the deactivator coil creating a gradually decreasing AC magnetic field in the deactivation zone. The deactivation cycle is completed when the current in the coil and the deactivation magnetic field has decayed to a relatively low level. After the deactivation cycle is complete the deactivation capacitor is recharged. Once the deactivation capacitor is completely recharged, the deactivator is ready for another deactivation cycle.

While the deactivation capacitor is recharging, the deactivator cannot be used to deactivate any markers. It may therefore be desirable to reduce this recharge time, particular for high volume applications where a customer may desire to deactivate many security labels on products within a short period of time. This requirement may influence the design of the power supply used for the deactivator. For example, a typical fully charged deactivation capacitor may have a capacitance of approximately 100 Microfarads (uF) and be charged to approximately 500 volts (V). The amount of energy stored in the capacitor may be approximately 12.5 Joules. In high volume applications, it may be necessary to recharge the capacitor in less than 250 milliseconds. The power supply for this application would need to deliver an average of 50 Watts of power during the 250 milliseconds charge time to meet this requirement. The peak power requirements for the power supply are often substantially higher due to inrush current limiting that is needed when the capacitor is near 0 Volts. For this application, the power supply may be required to deliver a peak power of 100 Watts. Although the peak power requirements are relatively high, the average power requirement may be substantially lower. For example, the deactivator may be required to perform only one deactivation cycle per second on average. In a deactivator with a deactivation energy requirement of 12.5 joules, this is 12.5 Watts or $1/8^{th}$ of the peak power requirement.

Conventional techniques to recharge the deactivation capacitor may be unsatisfactory for a number of reasons. For example, the deactivation capacitor may be charged directly from a DC power supply capable of delivering high peak power to the capacitor to meet recharge time requirements. This approach, however, may increase the size and cost of the power supply. In another example, bulk capacitors may be used. The bulk capacitors may be kept charged to a voltage that is greater than the deactivation capacitor voltage. During the recharge time, a switch is turned on and current flows into the deactivation capacitor through a current limiting resistor. The resistance of the current limiting resistor is chosen to limit the peak currents during the capacitor recharge. If a switch is not used between the bulk capacitor and the resonant capacitor, the limiting resistor also must be sized to limit the current through the power supply output rectifier during the portion of the deactivation cycle when the deactivation capacitor is negatively biased with respect to the bulk capacitor.

Although the use of bulk capacitors with a current limiting resistor may help to reduce the peak power requirements of the power supply, there remain several disadvantages. For example, the use of bulk capacitors slows the rate at which the deactivation capacitor may be recharged. The rate is especially slow at the end of the recharge cycle when the deactivation capacitor voltage approaches the voltage on the bulk capacitors. The recharge rate may be improved by increasing the voltage of the bulk capacitors to a voltage substantially higher than the deactivation capacitor voltage or by increasing the current rating on the switch and power supply rectifiers and current limiting resistor, but this may increase the cost of the components. In another example, conventional techniques using bulk capacitors may be inefficient. The current limiting resistor consumes a substantial amount of power during the recharge. This decreases the efficiency of the deactivator and increases the average power of the power supply. In yet another example, the current limiting resistor usually requires heat sinking which also increases the cost of the deactivator.

The embodiment may solve these and other problems using an inductive charging technique to transfer energy from an AC power source such as the power line or from a DC power source or bulk capacitors into the deactivation circuit. This may occur rapidly without the need for dissipative current limiting control elements such as resistors or transistors. Some embodiments may use the inductive reactance of the deactivator antenna to limit the input current without the high resistive losses of the limiting resistor or other current limiting regulator. This may result in increased efficiency and less complex energy transfer.

In some embodiments, the inductive charge technique stores energy in the deactivation antenna. This energy is then transferred into the deactivation capacitor eliminating the need for a high voltage power supply to recharge the deactivation capacitor. By way of contrast, conventional deactivators may focus on charging the deactivation capacitor with the energy needed for deactivation prior to the beginning of the deactivation cycle.

The embodiments may use at least two input power sources. For example, some embodiments may use a DC power source such as a bulk capacitor(s), a battery, and so forth. In another example, some embodiments may use an AC power source such as the AC mains for a retail store, home or office.

When using the AC power source there are at least two possible implementations that may be used with respect to the timing of the turn off of the charging switch. The first is using zero voltage switching for the charge switch turn off. The second is not using zero voltage switching for the charge switch turn off, but rather some other timing mechanism desired for a given implementation.

Some embodiments may include at least two possible implementations with respect to the energy transfer. The first is to transfer all of the energy into the deactivation circuit in a single cycle. The second is to use multiple cycles to transfer energy into the deactivation circuit.

Some embodiments may include at least two possible implementations with respect to discharge/recharge timing to shape the deactivation envelope. The first is where the deactivation envelope is allowed to ring down according to the natural decay of the LCR circuit. The second is where the deactivation envelope is modified by pausing the natural ring down LCR circuit by turning off the deactivation switch at one or more places during the deactivation cycle and executing partial recharge of the deactivation circuit with one or more recharge cycles. This may allow the decay rate of the LCR circuit to be decreased.

Referring now in detail to the drawings wherein like parts may be designated by like reference numerals throughout, there is illustrated in FIG. 1 a deactivator having a direct current (DC) power source in accordance with one embodiment. FIG. 1 illustrates a deactivator 100. Deactivator 100 may comprise a number of different elements. It may be appreciated that other elements may be added to deactivator 100, or substituted for the representative elements shown in FIG. 1, and still fall within the scope of the embodiments. The embodiments are not limited in this context.

In one embodiment, deactivator 100 may have a deactivation cycle and charge cycle. During the deactivation cycle, deactivator 100 may be used to deactivate an EAS marker. During the charge cycle, deactivator 100 may be charged prior to the next deactivation cycle. Although the charge cycle may occur at any time prior to the deactivation cycle, it may be advantageous to configure deactivation control 106 to charge deactivation capacitor 114 immediately prior to the deactivation cycle, as discussed in more detail below.

In one embodiment, a DC power source such as a set of bulk capacitors 104 may be used as a power source for deactivator 100. Bulk capacitors 104 may be charged with a DC voltage. The relatively large bulk capacitance allows the rating on the power supply to be reduced to supply only the average deactivation power rather than the peak power.

In one embodiment, a deactivation circuit 102 may be connected to power source 104. Deactivation circuit 102 may be arranged to inductively charge a deactivation capacitor 114 using power source 104 during a charge cycle, and generate a magnetic field having a deactivation envelope to deactivate a security tag during a deactivation cycle.

In one embodiment, deactivation circuit 102 may include a deactivation control 106 connected to a charge switch 108 and a deactivation switch 110. Charge switch 108 may be connected between power source 104 and a deactivation antenna 112. Deactivation antenna 112 may be connected in parallel to deactivation capacitor 114. A flyback diode 116 may be connected between deactivation antenna 112 and deactivation capacitor 114, and in parallel to deactivation switch 110.

In one embodiment, charge switch 108 and deactivation switch 110 may be implemented with many different types of semiconductors. In one embodiment, for example, charge switch 108 may be implemented using a Silicon Controlled Rectifier (SCR), bipolar transistor, insulated gate bipolar transistor (IGBT), metal oxide semiconductor field effect transistor (MOSFET) with a series diode, relay, and so forth. In one embodiment, for example, deactivation switch 110 may be implemented using a Triac, parallel inverted SCRs, IGBT, MOSFET, relay, and so forth. The embodiments are not limited in this context.

In one embodiment, deactivation control 106 may turn on charge switch 108 to begin the charge cycle. Turning on charge switch 108 may cause power source 104 to charge deactivation antenna 112. Charge switch 108 may remain turned on until a current has reached a predetermined threshold value. The predetermined threshold value may vary according to a given implementation, as discussed further below. Turning off charge switch 108 may cause deactivation antenna 112 to transfer the stored energy to deactivation capacitor 114. Turning off charge switch 108 may reverse a voltage on deactivation antenna 112 and forward bias flyback diode 116. The forward bias of flyback diode 116 may cause energy stored in deactivation antenna 112 to flow into deactivation capacitor 114. The energy stored in deactivation antenna 112 may continue to flow into deactivation capacitor 114 until a current for deactivation antenna 112 reaches approximately zero, at which point flyback diode 116 may be turned off.

To describe the charge cycle in more detail, when charge switch 108 is turned on current begins to flow into deactivation antenna 112 through charge switch 108. If the source voltage is held constant during the charge interval, the rate of change of the current in the inductor changes as a function of the source voltage and the inductance of the antenna, as shown in equation (1) as follows:

$$\frac{dI}{dt} = \frac{V_{source}}{L_{antenna}} \tag{1}$$

The energy stored in the inductor is given by equation (2) as follows:

$$E = \frac{1}{2} L I_{pk}^2 \tag{2}$$

Deactivation control 106 can be designed to turn off charge switch 108 when the current has reached a level to provide a proper energy to deactivation circuit 102. When charge switch 108 is turned off, the voltage on deactivation antenna 112 immediately reverses and forward biases flyback diode 116 in deactivation circuit 102. This may cause the energy stored in the inductance of deactivation antenna 112 to begin to flow into deactivation capacitor 114. With flyback diode 116 forward biased, the inductance of deactivation antenna 112 and the capacitance of deactivation capacitor 114 may form a resonant tank circuit. Assuming negligible losses in series resistance of deactivation antenna 112, the losses of flyback diode 116 and the ESR of deactivation capacitor 114, most or all of the energy stored in the inductance of deactivation antenna 112 would be transferred to deactivation capacitor 114. The voltage of deactivation capacitor 114 may be a value as given by equation (3) as follows:

$$E = \frac{1}{2} C V_{pk}^2 \tag{3}$$

When the current for deactivation antenna 112 drops to approximately zero, flyback diode 116 may be turned off. This completes an inductive charge cycle.

In one embodiment, all of the energy needed for the deactivation of an EAS label or marker may be delivered to deactivation capacitor 114 in a single charge cycle. Alternate embodiments may provide for the full energy needed for deactivation of an EAS label or marker to be transferred in two or more charge cycles. The embodiments are not limited in this context.

In one embodiment, deactivation control 106 may turn on deactivation switch 110 to begin a deactivation cycle. Deactivation switch 110 and flyback diode 116 along with deactivation antenna 112 and deactivation capacitor 114 may form a resonant tank circuit. If the combined resistance of deactivation antenna 112 and flyback diode 116, the ESR of deactivation capacitor 114 and deactivation switch 110, is set low enough, the resonant tank circuit may oscillate in an underdamped resonance to form a decaying current through deactivation antenna 112. The decaying current may cause deactivation antenna 112 to form a decaying magnetic field in accordance with the deactivation envelope.

Figure 2:
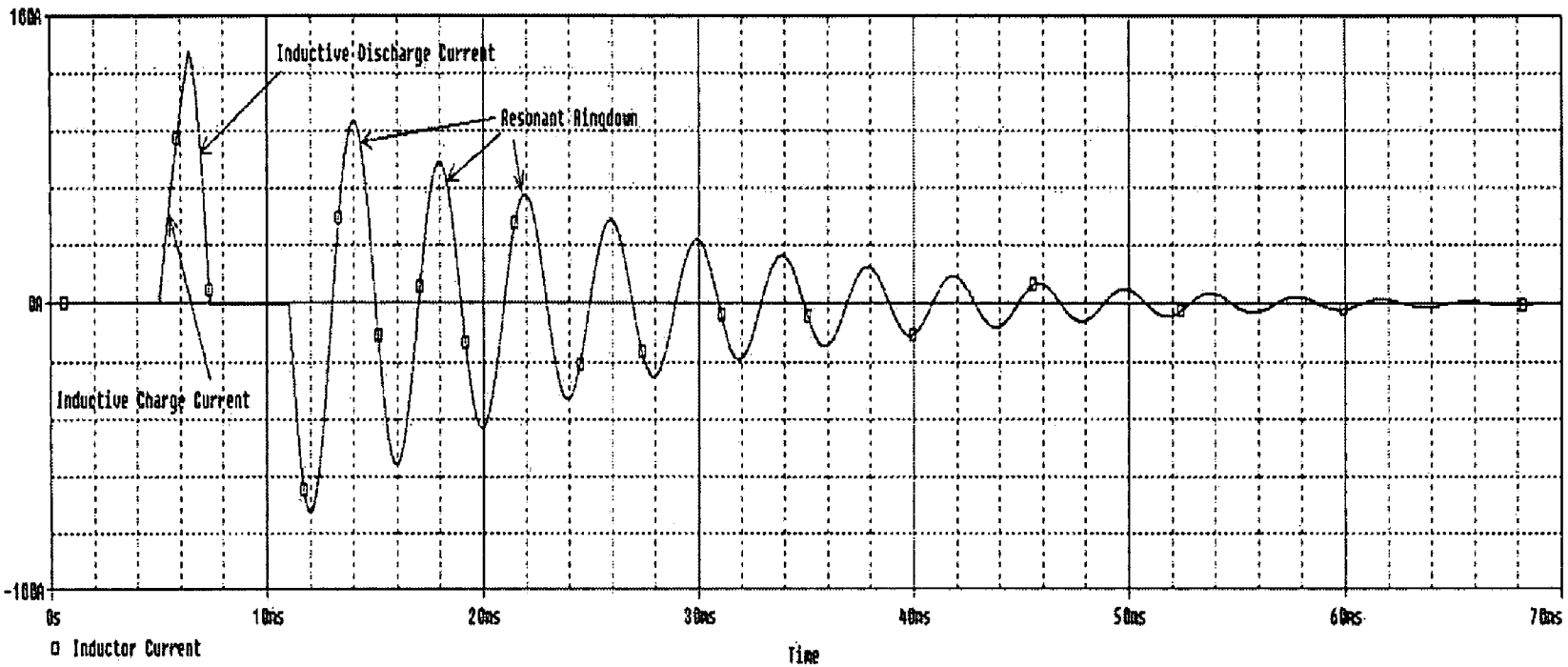
FIG. 2 illustrates a graph of a current waveform in a deactivation antenna having a DC power source in accordance with one embodiment.

FIG. 2 illustrates a graph of a current waveform in a deactivation antenna having a DC power source in accordance with one embodiment. FIG. 2 shows the current waveform through deactivation antenna 112 as described with reference to FIG. 1. When charge switch 108 is turned on, the inductive charge current ramps up in deactivation antenna 112. When the current in deactivation antenna 112 reaches an appropriate value, charge switch 108 may be turned off. An example of an appropriate value may comprise approximately 79 Amps through a 4 mH inductance for 12.5 Joules of stored energy. This may cause the current in deactivation antenna 112 to forward bias flyback diode 116 and inductive current may discharge into deactivation capacitor 114. A short time later the inductive discharge current in deactivation antenna 112 may drop to approximately zero. At some time after turn off of charge switch 108, deactivation switch 110 may be turned on. In this case, for example, deactivation switch 110 may be turned on at approximately 11 milliseconds (ms) and the energy stored in deactivation capacitor 114 discharges through deactivation switch 110 and flyback diode 116 forming an RLC tank circuit with deactivation antenna 112. The current in this tank circuit forms a resonant ring down current as shown in FIG. 2.

Although this implementation shows all of the energy stored in deactivation antenna 112 being dissipated prior to turning off deactivation switch 110, other implementations may allow some or all of the energy to ring down in the RLC circuit prior to another charge cycle. In other implementations, delays or pauses of the ring down waveform may be added by turning off the ring down switch between cycles of the ring down. Other implementations may allow the resonant tank circuit to be partially charged between cycles of the ring down to allow for a slower effective decay of the ring down envelope.

Figure 3:
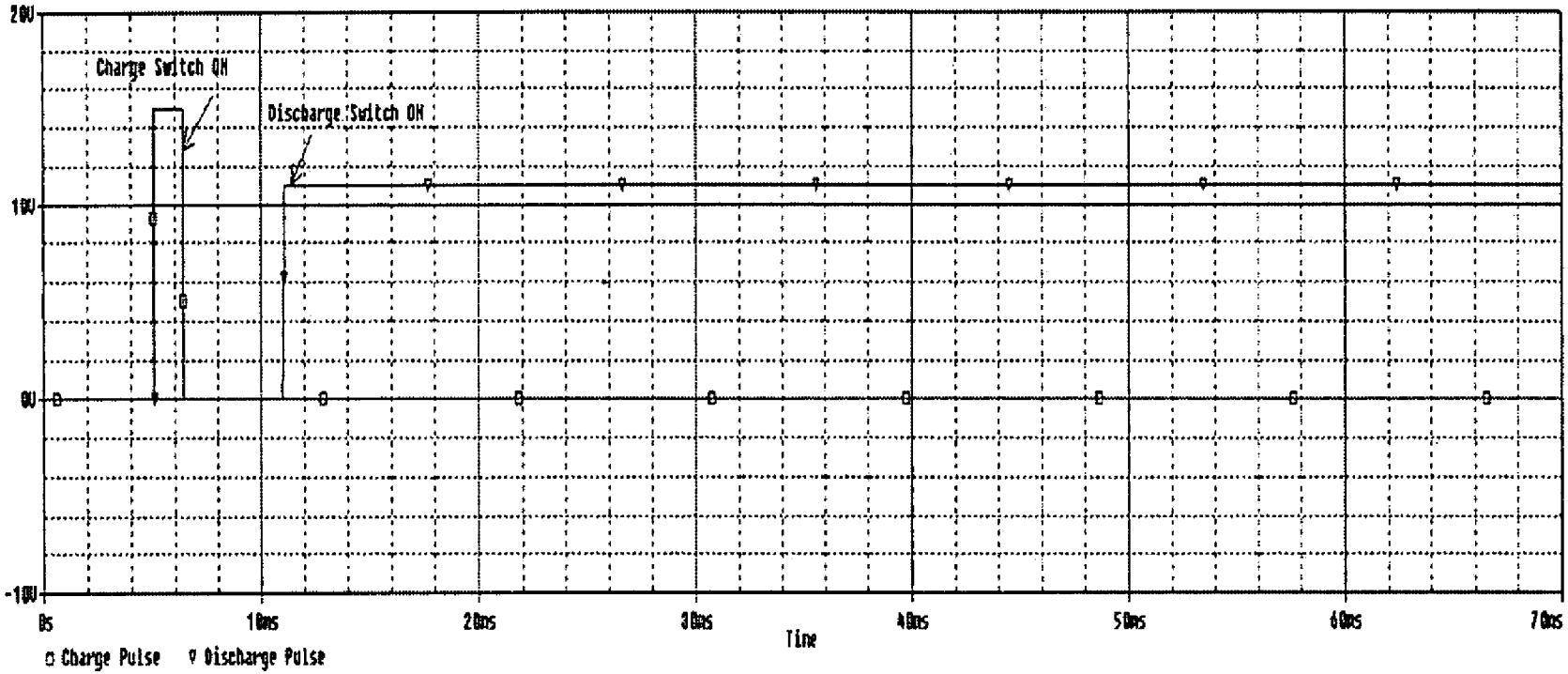
FIG. 3 illustrates a graph of a timing waveform in an inductive deactivation control circuit for a charge switch and deactivation switch having a DC power source in accordance with one embodiment.

FIG. 3 illustrates a graph of a timing waveform in a deactivation antenna having a DC power source in accordance with one embodiment. FIG. 3 shows the timing waveforms coming from deactivation control 106. As shown in FIG. 3, the first pulse may turn on charge switch 108. The second pulse may turn on deactivation switch 110 to allow the energy in deactivation capacitor 114 to ring down through deactivation antenna 112.

Figure 4:
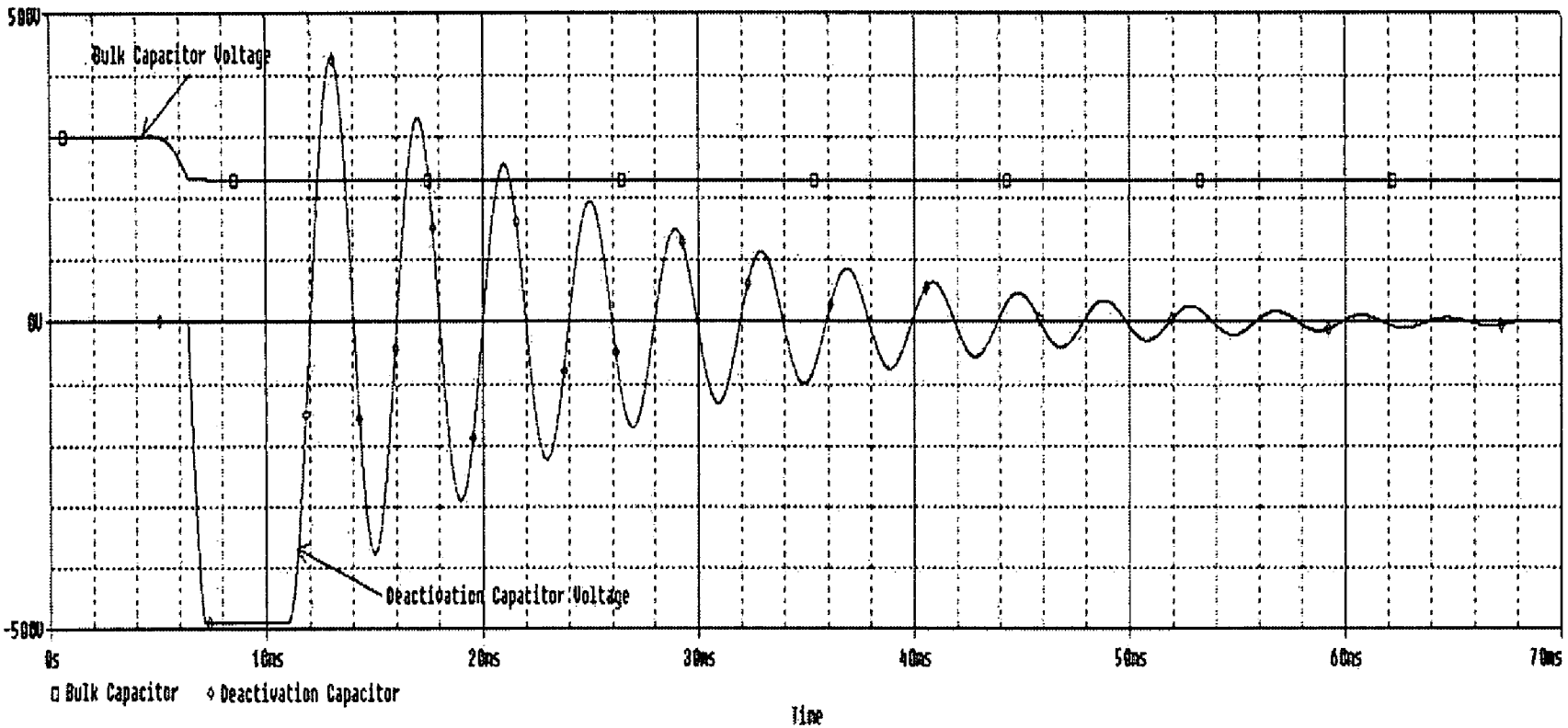
FIG. 4 illustrates a graph of voltage waveforms in a deactivation capacitor and a set of bulk capacitors having a DC power source in accordance with one embodiment.

FIG. 4 illustrates a graph of voltage waveforms in a deactivation capacitor and a set of bulk capacitors having a DC power source in accordance with one embodiment. FIG. 4 shows the voltage on deactivation capacitor 114 and the voltage on bulk capacitors 104. After charging deactivation antenna 112, deactivation control 106 may turn off charge switch 108. The energy stored in deactivation antenna 112 may be quickly transferred from deactivation antenna 112 into deactivation capacitor 114. Deactivation capacitor 114 in this example is charged to about 490 volts in approximately 1 ms.

FIG. 4 also illustrates a voltage waveform on bulk capacitors 104. During the time that the current is ramping up in deactivation antenna 112, the voltage may drop in bulk capacitors 104. During this time the voltage for bulk capacitors 104 may drop from 300 volts down to approximately 230 volts. A larger capacitance value for bulk capacitors 104 would allow a lower voltage drop. Further, a larger number of bulk capacitors placed in parallel may allow for lower charge pulse currents in each of the individual capacitors. The embodiments are not limited in this context.

In the previously described implementation, there may be a period of time after all of the energy charged in deactivation antenna 112 has been transferred into deactivation capacitor 114 when the current in deactivation antenna 112 drops to approximately zero. This pause before the turn on of deactivation switch 110 and the beginning of the deactivation cycle is not necessary when a single charge cycle is used to charge deactivation circuit 102. The following figures show the waveforms for an alternate implementation where deactivation switch 110 is turned on after charge switch 108 has been turned off but before the inductive discharge current has fallen to approximately zero. In this manner, some embodiments may provide a continuous ring down current waveform.

Figure 5:
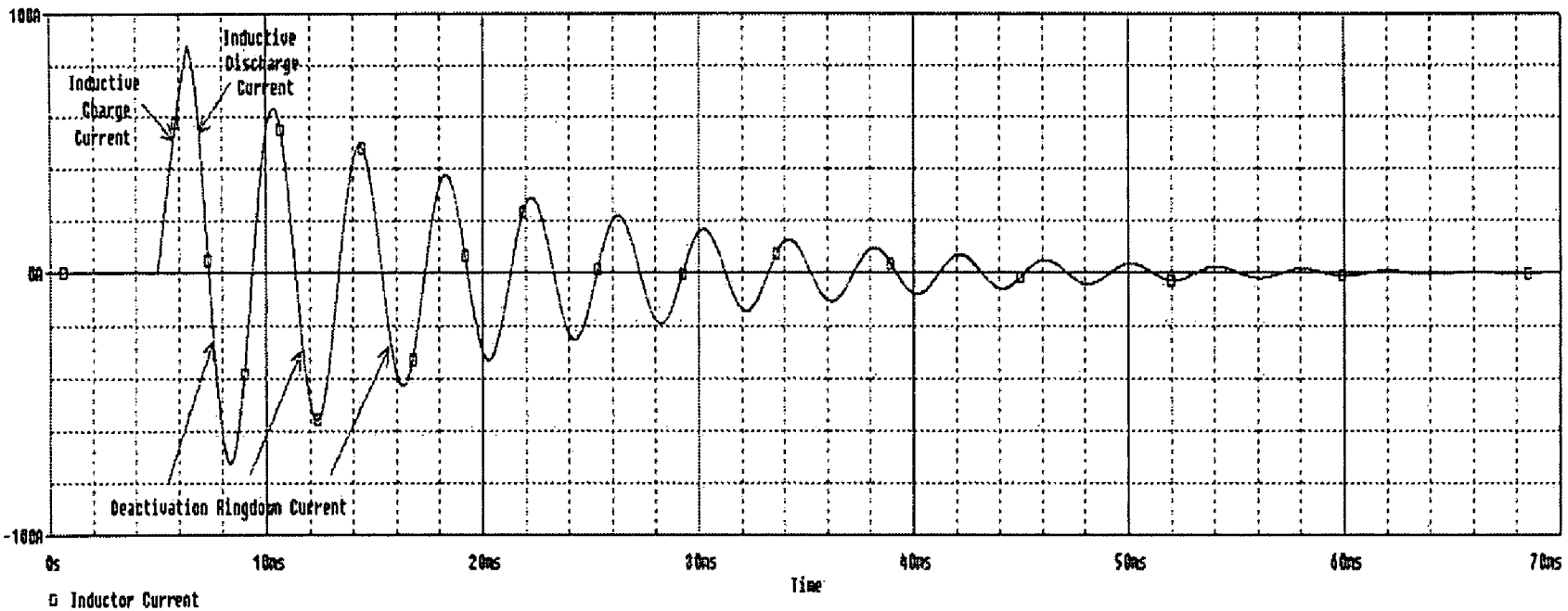
FIG. 5 illustrates a graph of a current waveform in a deactivation antenna having a continuous ring down current waveform in accordance with one embodiment.
Figure 6:
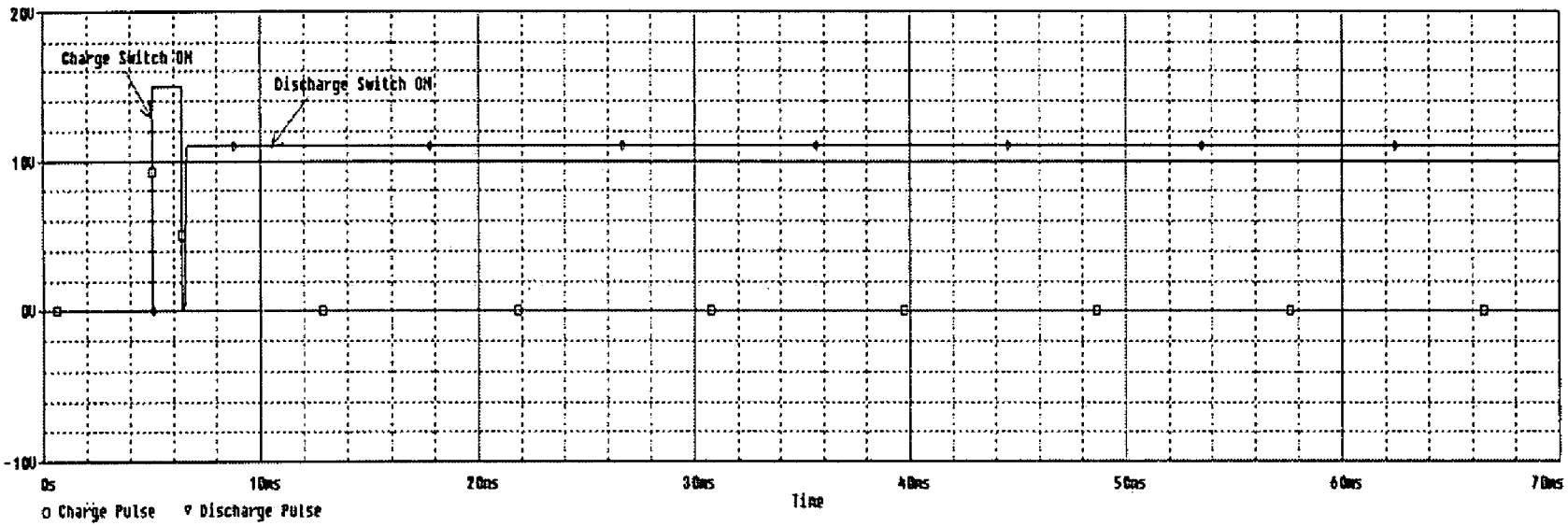
FIG. 6 illustrates a graph of a timing waveform in an inductive deactivation control circuit for a charge switch and deactivation switch having a continuous ring down current waveform in accordance with one embodiment.
Figure 7:
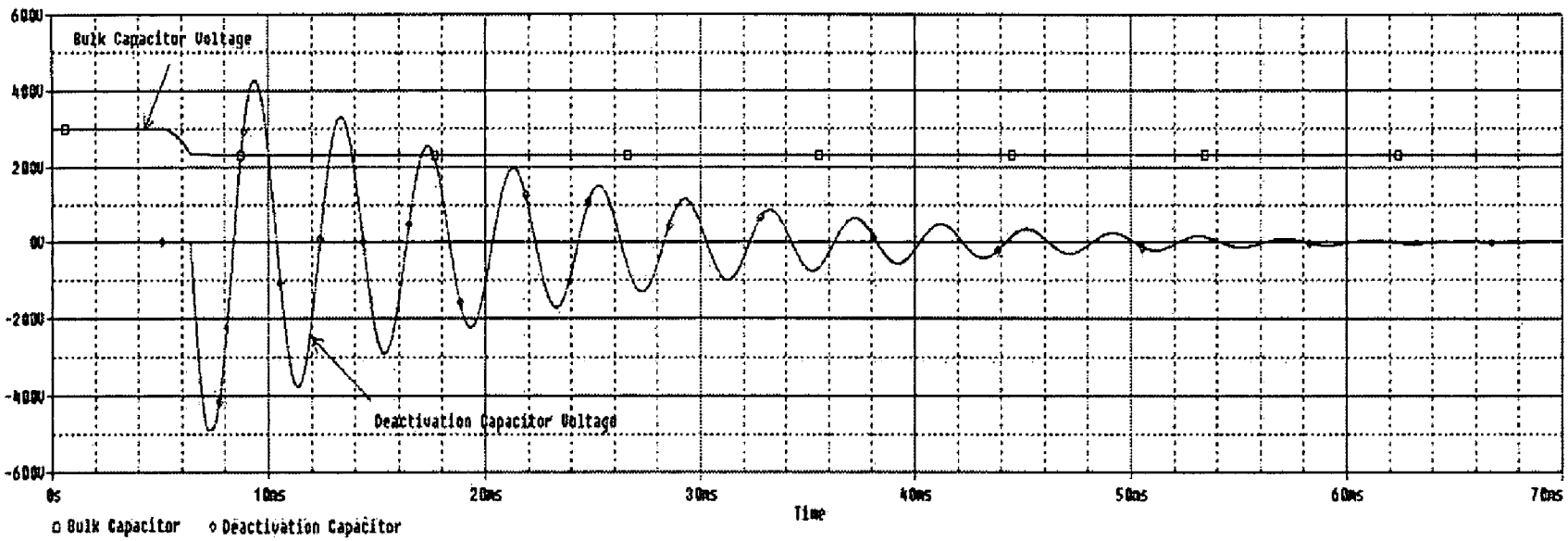
FIG. 7 illustrates a graph of voltage waveforms in a deactivation capacitor and a set of bulk capacitors having a continuous ring down current waveform in accordance with one embodiment.

FIGS. 5-7 show the deactivation antenna current waveforms, the control waveforms for charge switch 108 and deactivation switch 110, and the voltages on deactivation capacitor 114 and bulk capacitors 104 when implemented with deactivation control 106 arranged to provide a continuous ring down current. More particularly, FIG. 5 illustrates a graph of a current waveform in a deactivation antenna having a continuous ring down current waveform in accordance with one embodiment. FIG. 6 illustrates a graph of a timing waveform in a deactivation antenna for a continuous ring down current waveform in accordance with one embodiment. FIG. 7 illustrates a graph of voltage waveforms in a deactivation capacitor and a set of bulk capacitors having a continuous ring down current waveform in accordance with one embodiment. The embodiments are not limited in this context.

Figure 8:
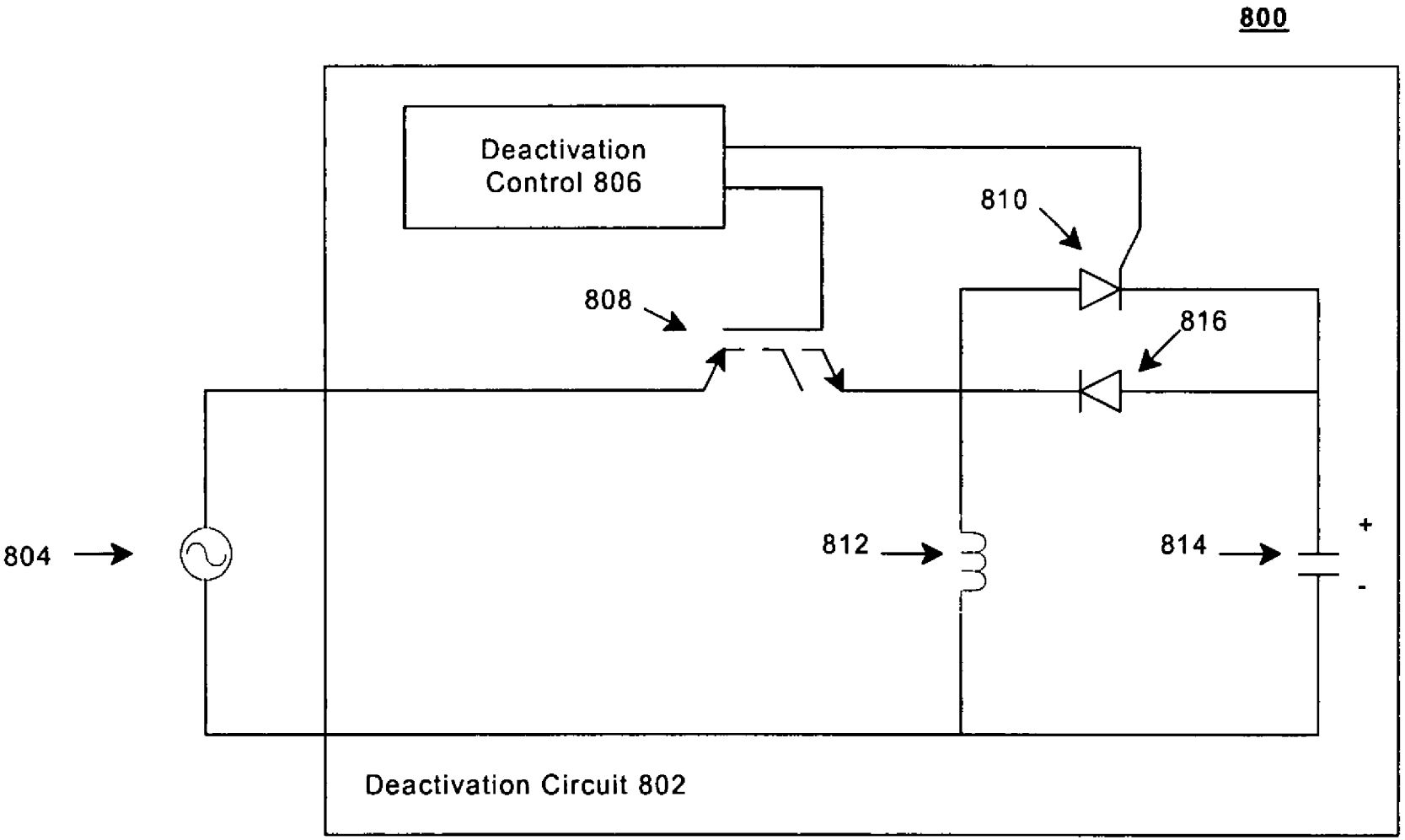
FIG. 8 illustrates a deactivator having an alternating current (AC) power source in accordance with one embodiment.

FIG. 8 illustrates a deactivator having an AC power source in accordance with one embodiment. FIG. 8 may illustrate an alternate implementation connecting the inductive charge circuit to an AC power source such as the power mains. More particularly, FIG. 8 may illustrate a deactivator 800. Deactivator 800 may comprise a number of different elements. It may be appreciated that other elements may be added to deactivator 800, or substituted for the representative elements shown in FIG. 8, and still fall within the scope of the embodiments. The embodiments are not limited in this context.

In one embodiment, deactivator 800 may be similar to deactivator 100 as described with reference to FIG. 1. For example, elements 102, 108, 110, 112, 114 and 116 may be similar to corresponding elements 802, 808, 810, 812, 814 and 816. Deactivator 800, however, may be connected to an AC power source 804 rather than a DC power source 104 as described in FIG. 1. Further, deactivator control 806 may use different timing waveforms to control charge switch 808 and deactivation switch 810 relative to AC power source 804.

In operation, deactivation control 806 may turn on charge switch 808 during one or more positive cycles of AC power source 804. Although charge switch 808 may be turned at any point during the positive cycle of AC power source 804, one possible implementation may turn on charge switch 808 at the positive zero crossing of AC power source 804. The following figures detail the waveforms associated with this implementation.

Figure 9:
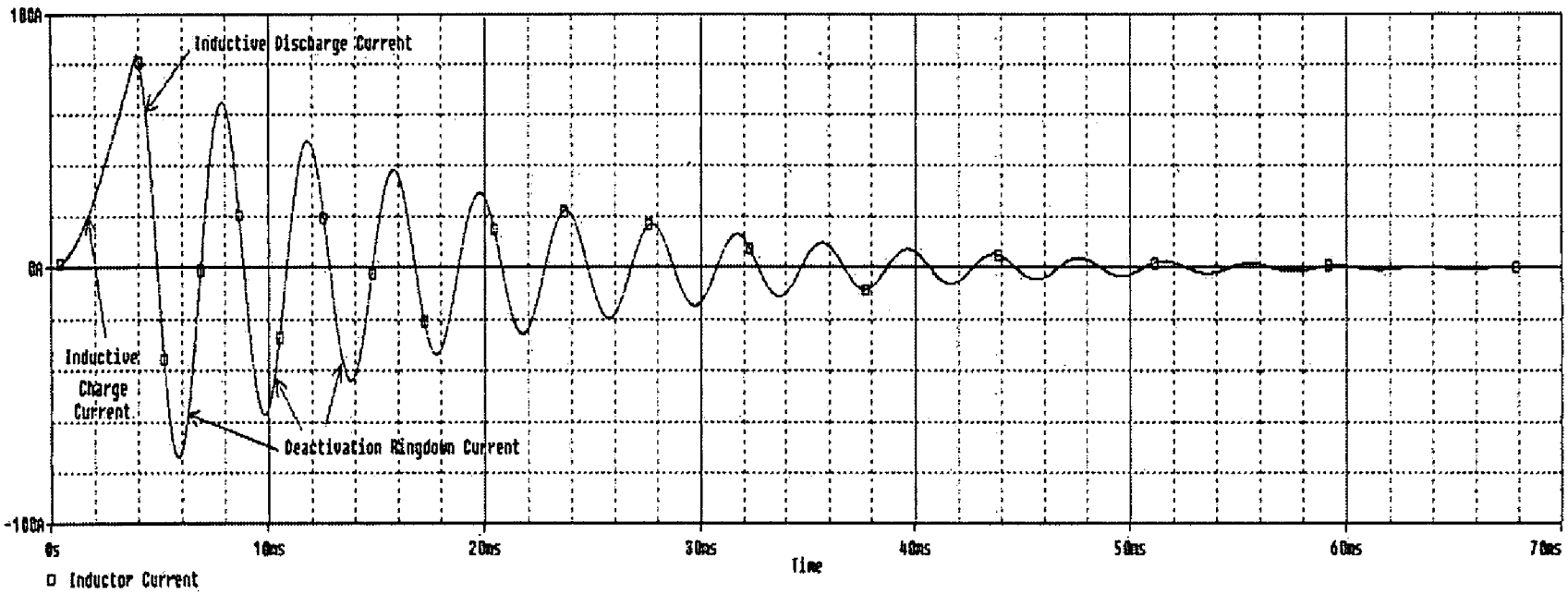
FIG. 9 illustrates a graph of current waveform in a deactivation antenna having an AC power source in accordance with one embodiment.

FIG. 9 illustrates a graph of current waveform in a deactivation antenna having an AC power source in accordance with one embodiment. FIG. 9 shows the current waveform in deactivation antenna 812 using a turn on at the positive line crossing (e.g., in this case at 0 milliseconds) and a deactivation switch 810 timing for a continuous ring down current waveform.

Figure 10:
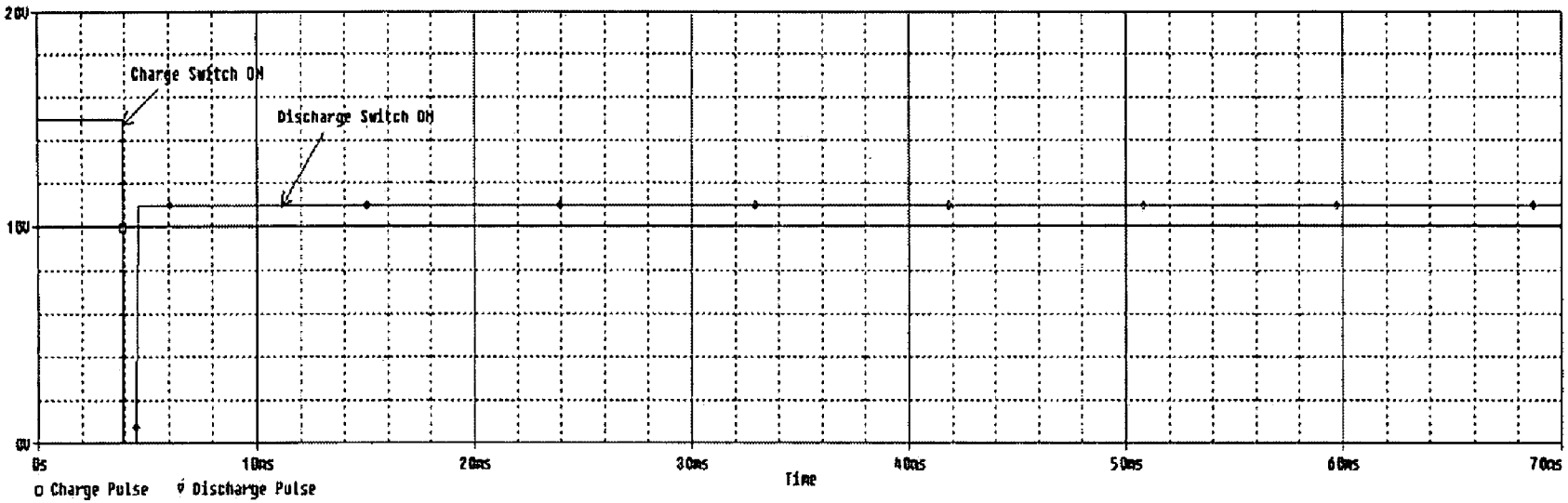
FIG. 10 illustrates a graph of timing waveforms in a deactivation control circuit for a charge switch and deactivation switch having an AC power source in accordance with one embodiment.

FIG. 10 illustrates a graph of timing waveforms for an AC power source in accordance with one embodiment. FIG. 10 shows the timing waveforms for the turn on of charge switch 808 for a turn on at the positive line crossing.

Figure 11:
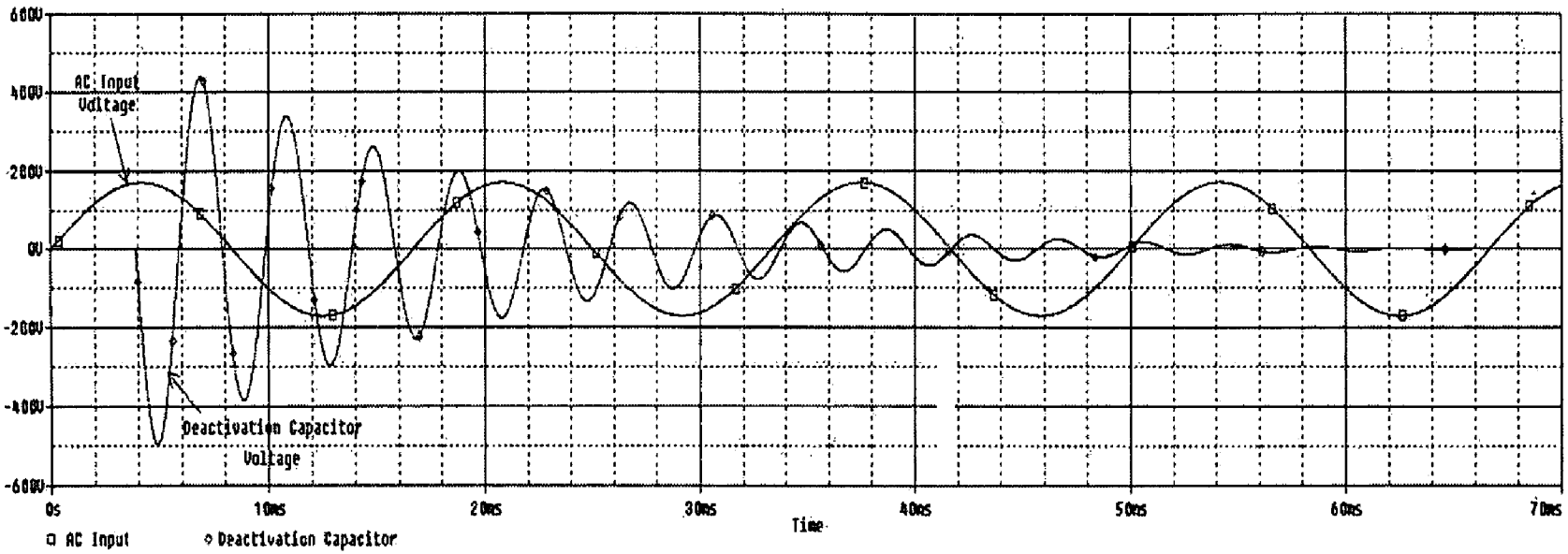
FIG. 11 illustrates a graph of voltage waveforms on a deactivation capacitor having an AC power source in accordance with one embodiment.

FIG. 11 illustrates a graph of voltage waveforms on a deactivation capacitor having an AC power source in accordance with one embodiment. FIG. 11 shows the voltages on AC power source 804 and deactivation capacitor 814 for one embodiment.

In one embodiment, the inductance of deactivation antenna 812 is fully charged in a single charge cycle to an energy level needed to adequately deactivate an EAS label or marker. In a similar implementation to the above, deactivation antenna 812 may be partially charged during two or more consecutive cycles with energy allowed to flow into deactivation capacitor 814 at the end of each charge cycle. Once deactivation capacitor 814 is fully charged with adequate energy for deactivation, deactivation switch 810 may be turned on to allow deactivation energy to ring down through deactivation antenna 812.

In one embodiment, deactivation switch 810 may be turned off prior to complete discharge of deactivation circuit 802 and one or more charge cycles may be executed to allow a partial charging of deactivation circuit 802. This technique may be used to shape the deactivation ring down envelope.

Yet another implementation is possible when connecting to AC power source 804. In this implementation, the turn-on and turn-off of charge switch 808 is timed by deactivation control 806 so that an appropriate energy is stored in deactivation antenna 812 and the turn off of charge switch 808 occurs at or near the zero crossing of AC power source 804. For example, deactivation control 806 may turn on charge switch 808 at or sometime after the positive zero crossing of AC power source 804, and may turn off charge switch 808 during a negative zero crossing of AC power source 804. The latter case may cause the turn-off of charge switch 808 to occur when the voltage across it is very low. This control technique has the advantage of greatly reducing the turn off losses of charge switch 808. The embodiments are not limited in this context.

Figure 12:
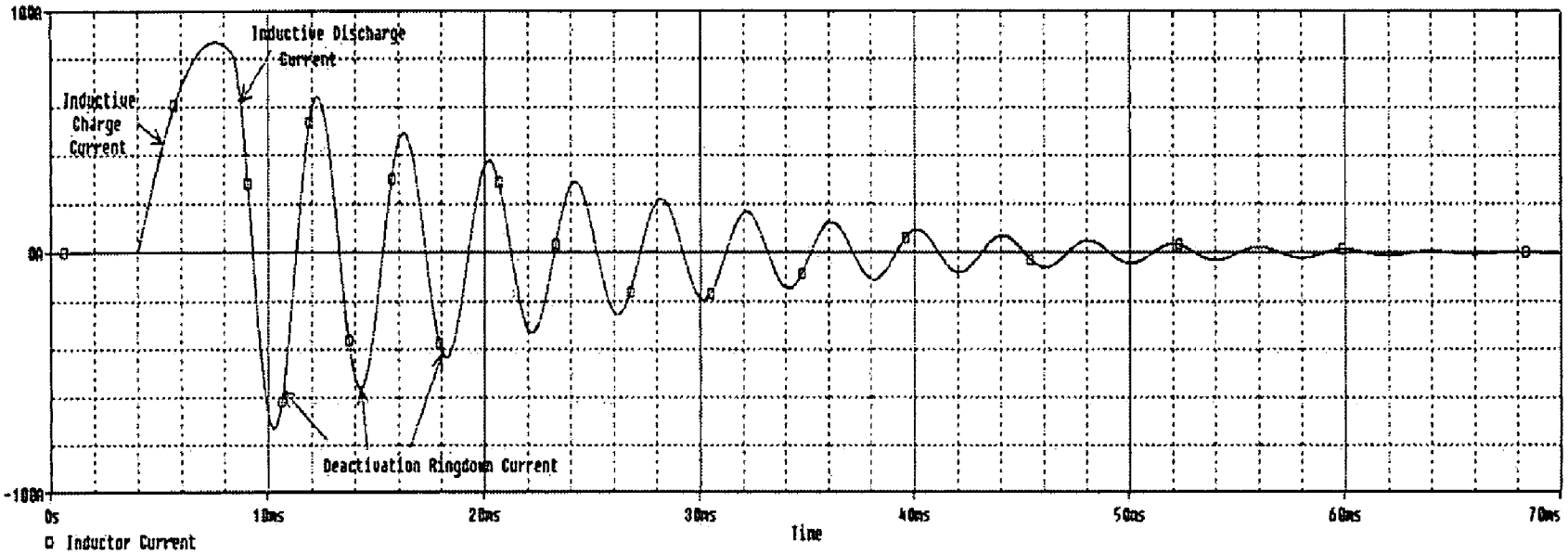
FIG. 12 illustrates a graph of current waveforms in a deactivation antenna with an AC power source and zero voltage switching in accordance with one embodiment.
Figure 13:
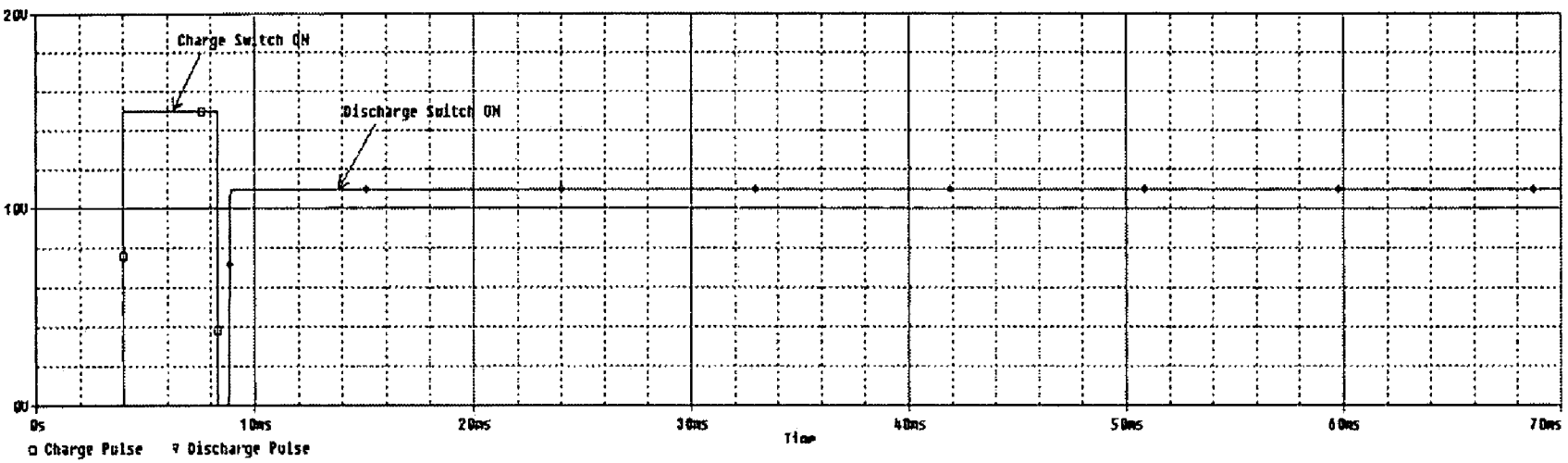
FIG. 13 illustrates a graph of timing waveforms in a deactivation control circuit for a charge switch and deactivation switch having zero voltage switching in accordance with one embodiment.
Figure 14:
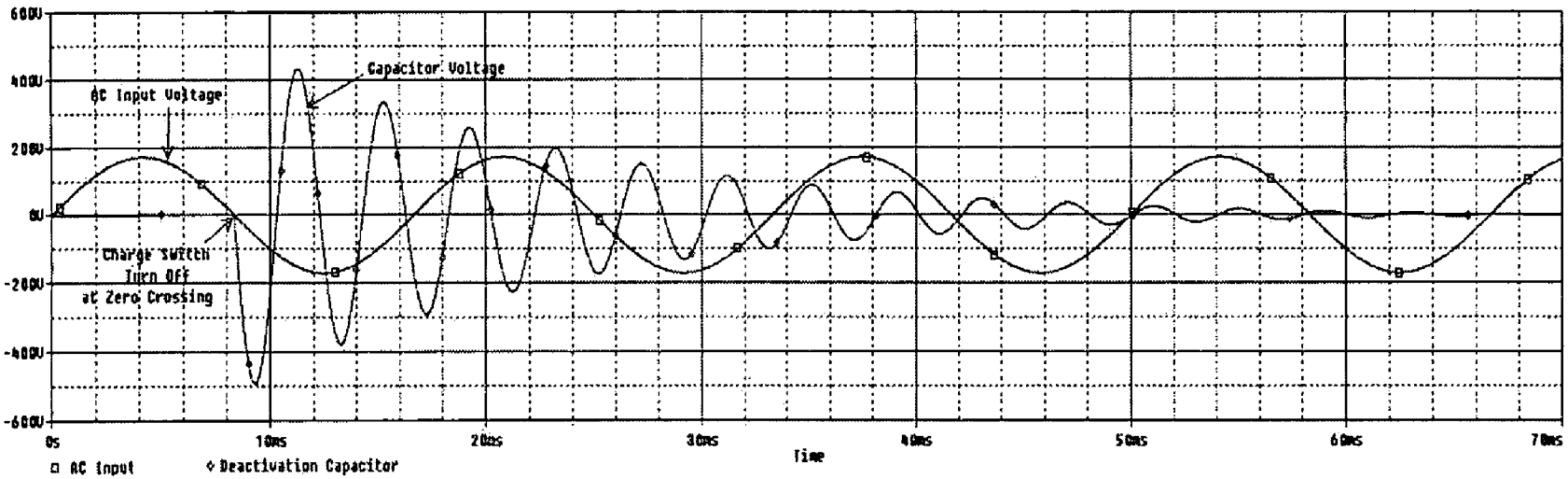
FIG. 14 illustrates voltage waveforms on the AC power source and deactivation capacitor with zero voltage switching in accordance with one embodiment.

FIGS. 12-14 may illustrate the inductive charge deactivation circuit connected to an AC source using zero voltage switching (ZVS). More particularly, FIG. 12 illustrates a graph of current waveforms in a deactivation antenna with an AC power source and zero voltage switching in accordance with one embodiment. FIG. 13 illustrates a graph of timing waveforms for a charge switch and deactivation switch with zero voltage switching in accordance with one embodiment. FIG. 14 illustrates voltage waveforms on the AC power source and deactivation capacitor with zero voltage switching in accordance with one embodiment.

The embodiments may offer several advantages over conventional deactivators. For example, some embodiments may use the inductive element of the deactivation coil in the circuit for energy storage and transfer. This allows the deactivation circuit to be implemented without the need for additional expensive inductive elements. In another example, some embodiments may reduce or eliminate the need for a high voltage power supply to recharge the deactivation capacitor. This typically reduces the cost of the deactivator. In yet another example, the operating voltage on the deactivation capacitor is not necessarily constrained by the AC or DC source voltage. For instance, some embodiments can be used with a deactivation capacitor operating at approximately 500 volts with a source voltage lower than 200 volts such as operation using AC line voltages in the United States. In still another example, energy may be transferred very efficiently and quickly into the deactivation circuit in a single charge cycle or in several charge cycles at the beginning of the deactivation period. Because this can occur almost instantaneously, the deactivation capacitor may be recharged very rapidly at the beginning of the deactivation cycle. This may eliminate the need for a recharge period during which the deactivator may not be used. Since the deactivation capacitor is idled in a discharged state, this may also extend the life of the capacitor.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

What is claimed is:

1. An apparatus, comprising:

a power source; and a deactivation circuit connected to said power source, said deactivation circuit to inductively charge a deactivation antenna using said power source during a charge cycle, and generate a magnetic field having a deactivation envelope to deactivate a security tag during a deactivation cycle.

2. The apparatus of claim 1, wherein said deactivation circuit comprises a deactivation control connected to a charge switch and a deactivation switch, said charge switch connected between said power source and said deactivation antenna, said deactivation antenna connected in parallel to a deactivation capacitor, and a flyback diode connected between said deactivation antenna and said deactivation capacitor and in parallel to said deactivation switch.

3. The apparatus of claim 2, wherein said deactivation control turns on said charge switch to begin said charge cycle and causes said power source to charge said deactivation antenna, and turns off said charge switch to cause said deactivation antenna to transfer said energy to said deactivation capacitor.

4. The apparatus of claim 3, wherein said charge switch remains turned on until a current has reached a predetermined threshold value.

5. The apparatus of claim 3, wherein said deactivation control turns off said charge switch to reverse a voltage on said deactivation antenna and forward bias said flyback diode, said forward bias to cause energy stored in said deactivation antenna to flow into said deactivation capacitor.

6. The apparatus of claim 5, wherein said energy stored in said deactivation antenna flows into said deactivation capacitor until a current for said deactivation antenna reaches approximately zero and said flyback diode is turned off.

7. The apparatus of claim 5, wherein said deactivation control turns on said deactivation switch to begin a deactivation cycle, said deactivation switch and said flyback diode along with said deactivation antenna and said deactivation capacitor to form a resonant circuit, with said resonant circuit to oscillate in an underdamped resonance to form a decaying current through said deactivation antenna, said decaying current to cause said deactivation antenna to form a decaying magnetic field in accordance with said deactivation envelope.

8. The apparatus of claim 7, wherein said deactivation control turns off said deactivation switch to end said deactivation cycle.

9. The apparatus of claim 8, wherein said deactivation control turns off said deactivation switch when all of said energy stored in said deactivation antenna has dissipated.

10. The apparatus of claim 8, wherein said deactivation control turns off said deactivation switch when some of said energy stored in said deactivation antenna has dissipated.

11. The apparatus of claim 8, wherein said deactivation control switches between partial charge cycles and partial deactivation cycles to form said deactivation envelope with a slower decay rate.

12. The apparatus of claim 5, wherein said deactivation control turns on said deactivation switch to begin said deactivation cycle after said charge switch is turned off and all of said energy stored in said deactivation antenna flows into said deactivation capacitor.

13. The apparatus of claim 5, wherein said deactivation control turns on said deactivation switch to begin said deactivation cycle after said charge switch is turned off and some of said energy stored in said deactivation antenna flows into said deactivation capacitor, said deactivation switch and said flyback diode along with said deactivation antenna and said deactivation capacitor to form a resonant circuit, with said resonant circuit to oscillate in an underdamped resonance to form a decaying current through said deactivation antenna, said decaying current to cause said deactivation antenna to form a continuous decaying magnetic field in accordance with said deactivation envelope.

14. The apparatus of claim 3, wherein said power source is an alternating current power source, and said deactivation control turns on said charge switch during one or more positive cycles of said alternating current power source.

15. The apparatus of claim 3, wherein said power source is an alternating current power source, and said deactivation control turns on said charge switch during a positive zero crossing of said alternating current power source.

16. The apparatus of claim 3, wherein said power source is an alternating current power source, and said deactivation control turns on said charge switch at sometime after a positive zero crossing of said alternating current power source while the AC voltage is positive.

17. The apparatus of claim 3, wherein said power source is an alternating current power source, and said deactivation control turns off said charge switch during a negative zero crossing of said alternating current power source.

18. The apparatus of claim 2, wherein said charge switch comprises one of a silicon controlled rectifier, bipolar transistor, insulated gate bipolar transistor, metal oxide semiconductor field effect transistor with a series diode, and relay.

19. The apparatus of claim 2, wherein said deactivation switch comprises one of a Triac, parallel inverted silicon controlled rectifiers, insulated gate bipolar transistor, metal oxide semiconductor field effect transistor, and relay.

20. The apparatus of claim 2, wherein said deactivation antenna and said deactivation capacitor are arranged to form an inductor-capacitor resonant tank circuit.

21. The apparatus of claim 1, wherein said power source is a direct current power source.

22. The apparatus of claim 21, wherein said direct current power source comprises multiple bulk capacitors.

23. The apparatus of claim 1, wherein said power source is an alternating current power source.

24. The apparatus of claim 1, wherein said deactivation circuit is arranged to inductively charge said deactivation capacitor using said power source during multiple charge cycles prior to each deactivation cycle.

25. A system, comprising:

a security tag; and a deactivator, said deactivator to include a power source connected to a deactivation circuit, said deactivation circuit to inductively charge a deactivation antenna using said power source during a charge cycle, and generate a magnetic field having a deactivation envelope to deactivate said security tag during a deactivation cycle.

26. The system of claim 25, wherein said deactivation circuit comprises a deactivation control connected to a charge switch and a deactivation switch, said charge switch connected between said power source and said deactivation antenna, said deactivation antenna connected in parallel to a deactivation capacitor, and a flyback diode connected between said deactivation antenna and said deactivation capacitor and in parallel to said deactivation switch.

27. The system of claim 26, wherein said charge switch remains turned on until a current has reached a predetermined threshold value.

28. The system of claim 27, wherein said energy stored in said deactivation antenna flows into said deactivation capacitor until a current for said deactivation antenna reaches approximately zero and said flyback diode is turned off.

29. The system of claim 27, wherein said deactivation control turns on said deactivation switch to begin a deactivation cycle, said deactivation switch and said flyback diode along with said deactivation antenna and said deactivation capacitor to form a resonant circuit, with said resonant circuit to oscillate in an underdamped resonance to form a decaying current through said deactivation antenna, said decaying current to cause said deactivation antenna to form a decaying magnetic field in accordance with said deactivation envelope.

30. The system of claim 29, wherein said direct current power source comprises multiple bulk capacitors.

31. The system of claim 26, wherein said deactivation control turns off said charge switch to reverse a voltage on said deactivation antenna and forward bias said flyback diode, said forward bias to cause energy stored in said deactivation antenna to flow into said deactivation capacitor.

32. The system of claim 26, wherein said deactivation switch comprises one of a Triac, parallel inverted silicon controlled rectifiers, insulated gate bipolar transistor, metal oxide semiconductor field effect transistor, and relay.

33. The system of claim 25, wherein said deactivation control turns on said charge switch to begin said charge cycle and causes said power source to charge said deactivation antenna, and turns off said charge switch to cause said deactivation antenna to transfer said energy to said deactivation capacitor.

34. The system of claim 25, wherein said power source is a direct current power source.

35. The system of claim 25, wherein said power source is an alternating current power source.

36. The system of claim 25, wherein said charge switch comprises one of a silicon controlled rectifier, bipolar transistor, insulated gate bipolar transistor, metal oxide semiconductor field effect transistor with a series diode, and relay.

37. The system of claim 25, wherein said deactivation antenna and said deactivation capacitor are arranged to form an inductor-capacitor resonant tank circuit.

38. A method, comprising:

receiving a signal to deactivate a marker at a deactivator;

charging a deactivation antenna from an power source during a charge cycle for said deactivator; and creating a deactivation field to deactivate said marker during a deactivation cycle for said deactivator, said deactivation field to generate a magnetic field having a deactivation envelope to deactivate said marker.

39. The method of claim 38, wherein said charging comprises:

turning on a charge switch to connect said power source to said deactivation antenna and charge said deactivation antenna with energy; and turning off a charge switch to transfer energy from said deactivation antenna to a deactivation capacitor.

40. The method of claim 39, wherein said creating comprises:

turning on a deactivation switch to send current from said deactivation capacitor to said deactivation antenna; and generating an alternating current magnetic field by said deactivation antenna accordance with said deactivation envelope.

41. The method of claim 40, further comprising generating control signals by a deactivation control to control said charge switch and said deactivation switch.

* * * * *